US005421097A

United States Patent [19]

Yamamoto et al.

[11] Patent Number: 5,421,097

[45] Date of Patent: Jun. 6, 1995

[54] TEMPERATURE CONTROL METHOD AND DRYING DEVICE FOR DRYING A PHOTOSENSITIVE MATERIAL

[75] Inventors: Kenro Yamamoto; Kazuyuki Kagawa; Yasuhiro Kawai, all of Kanagawa, Japan

[73] Assignee: Fuji Photo Film Co., Ltd., Kanagawa, Japan

[21] Appl. No.: 141,946

[22] Filed: Oct. 28, 1993

[30] Foreign Application Priority Data

Oct. 29, 1992 [JP] Japan ..... 4-291702

[51] Int. Cl.[6] ..... F28B 3/08

[52] U.S. Cl. ..... 34/446; 34/524; 34/553; 354/299

[58] Field of Search ..... 34/444, 446, 524, 549, 34/553, 535, 557, 573; 354/299, 319, 320, 321, 322

[56] References Cited

U.S. PATENT DOCUMENTS 4,914,835 4/1990 Kose et al. ..... 34/446

4,916,829 4/1990 Takiue et al. ..... 34/446

*Primary Examiner*—John M. Sollecito

*Attorney, Agent, or Firm*—Sughrue, Mion, Zinn, Macpeak & Seas; Richard C. Turner; Steven M. Gruskin

[57] ABSTRACT

In a temperature control method of a photosensitive material drying device relating to the present invention, a photosensitive material is heated and dried by drying air heated by a heating device. A temperature of a member heated by the drying air is detected, and operation of the heating device is controlled so that the temperature of the member is maintained within a predetermined range. Further, a photosensitive material drying device relating to the present invention includes a heating device supplying heated drying air to an interior of a drying chamber and heating and drying a photosensitive material for which processing by processing solutions has been completed; an exhaust grill through which exhaust air, which is discharged from a vicinity of a conveying path of the photosensitive material to an exterior of the drying chamber, passes; a temperature sensor, disposed at the exhaust grill in a state in which the temperature sensor is shielded from the drying air and detecting a temperature of the exhaust grill heated by the exhaust air; and a temperature control device which controls the heating device in accordance with a temperature detected by the temperature sensor.

34 Claims, 14 Drawing Sheets

TEMPERATURE CONTROL METHOD AND DRYING DEVICE FOR DRYING A PHOTOSENSITIVE MATERIAL

BACKGROUND OF THE INVENTION

1. Field of the Invention

The present invention relates to a temperature control method and a drying device for drying a photosensitive material, which has been processed by processing solutions, by heated drying air.

2. Description of the Related Art

A photosensitive material, such as a photosensitive film, on which imagewise light has been exposed, is subject to processing solutions such as developer, fixer, and washing water. Thereafter, the wet photosensitive material is finished by a drying device. Generally, in the photosensitive material drying device, while the photosensitive material is conveyed by a plurality of rollers disposed within a drying chamber, drying air, which is heated to a predetermined temperature, is blown to the surfaces of the photosensitive material. In order to provide drying air at a predetermined temperature, the temperature of the drying air supplied within the drying chamber is measured, and the temperature of a heater for heating the drying air is controlled so that the photosensitive material is dried in an optimal drying state.

In this way, the drying air is heated to the predetermined temperature by the heater. However, when the photosensitive material is transported through the drying chamber after the drying air is heated to the predetermined temperature, there may be drying irregularities in the photosensitive material. If the rollers, guides and the like disposed in the drying chamber for conveying the photosensitive material have not been heated to substantially the same temperature as the temperature of the drying air even if the drying air within the drying chamber is at the predetermined temperature, there is the concern that there will be drying irregularities in the photosensitive material because the photosensitive material is brought into contact with the relatively cold rollers, guides or the like in the chamber. Time is required for the rollers, guides and the like, which are disposed within the drying chamber and which convey the photosensitive material, to be heated to substantially the predetermined temperature by the drying air. Therefore, before the photosensitive material, which has been subjected to various processes such as developing, fixing, washing, etc. is dried, the heated drying air should be supplied to the interior of the drying chamber for enough time required for heating the rollers and the like to substantially the same temperature as the drying air which is heated to the predetermined temperature, i.e., the drying air is supplied for approximately a predetermined time.

While the photosensitive material is dried, the temperature of the heater is controlled so that the drying air is kept at approximately the predetermined temperature. However, when processing of photosensitive material has not been carried out for a long time, so-called "standby control" is effected in which a heater serving as a heating means is turned on and off at predetermined time intervals so that the temperature of the interior of the drying chamber is kept within a predetermined temperature range lower than the temperature of the drying air when the photosensitive material is dried. In this way, the temperature of the drying air may at any time be switched to the temperature at which drying of the photosensitive material is possible.

However, it is difficult to determine with absolute certainty the time required for heating the parts such as the rollers within the drying chamber to a temperature at which drying of the photosensitive material is possible. This time depends on the temperature surface temperature of the heater, air temperature in the drying chamber, atmospheric temperature, etc. Therefore, the raising time from the time the power source of the heater in the photosensitive material drying device is turned on to the time when drying of the photosensitive material is possible must be set with some leeway. In practice, even if the rollers and the like within the drying chamber have been heated to a temperature at which the photosensitive material can be dried under optimal conditions, we cannot start the operation of the drier or of the automatic developing processor, which is a drawback at times when it is desired to process and dry the exposed photosensitive material rapidly and to have the dried photosensitive material quickly. Further, when a photosensitive material is not being processed, the heater serving as the heating means is turned on and off in a preset cycle. The temperature of the rollers and the like is difficult to control, and the temperature does not fall within the predetermined temperature range.

SUMMARY OF THE INVENTION

In view of the aforementioned problems, an object of the present invention is to provide a temperature control method for a photosensitive material drying device, and a photosensitive material drying device in which start-up time of the device is shortened. Further, another object is to provide a temperature control method for a photosensitive material drying device, and a photosensitive material drying device, in which a photosensitive material is subject to drying processing in an optimal state even during processing of the photosensitive material.

In order to achieve the above-described objects, in accordance with one aspect of the present invention, a photosensitive material is heated and dried by drying air heated by a heating means. A temperature of a member disposed in the drying device and heated by the drying air is detected. Operation of the heating means is controlled so that the temperature of the member is maintained within a predetermined range.

In one aspect of the temperature control method of a photosensitive material drying device of the present invention, instead of detecting the temperature of rollers or the guides within a drying chamber which contact the photosensitive material, the temperature of a member, which is disposed in a vicinity of the drying air flow and in a portion of the drying chamber which the conveyed photosensitive material does not contact and which is heated by drying air supplied to the interior of the drying chamber, is detected.

The drying air supplied to the interior of the drying chamber heats the rollers and the like within the drying chamber. The temperature of a member which is disposed in a vicinity of the drying chamber and which is heated by the drying air is a temperature which is equivalent to or which is correlated with the temperature of tile rollers or the like. Namely, by detecting the temperature of the member heated by the drying air, the temperature of the rollers or the like can be easily known without directly mounting a temperature detecting sensor to the rotating rollers or the like in the drying chamber.

During start-up of operation of the drying device, if temperature control is effected on the basis of the measured value of the temperature of the member heated by the drying air, the temperature of the drying air within the drying chamber and the temperature of the rollers or the like can precisely be made to become desired temperatures. Further, there is no need to set a long start-up time for the rise in temperature of the rollers or the like of the drying chamber, and start-up operation of the drying device can thus be effected efficiently.

Further, when the drying device is in "standby control", if the heating means such as a heater or the like is turned on and off on the basis of the temperature of the member heated by the drying air, the interior of the drying chamber can accurately be maintained within a predetermined temperature range. When processing of a photosensitive material begins, the temperature within the drying chamber can accurately be made to become a predetermined temperature, unlike a case in which the heating means such as a heater or the like is controlled on the basis of the temperature of the drying air.

In accordance with another aspect of the present invention, a photosensitive material is heated and dried by drying air heated by a heating means. Operation of the heating means is controlled in accordance with temperature information of the member heated by the drying air and information regarding the processed amount of the photosensitive material so that the temperature of the member is maintained within a predetermined range.

In the temperature control method of a photosensitive material drying device of this aspect of the invention, the temperature of the rollers or the like within the drying chamber which varies in accordance with the drying processing of the photosensitive material can be maintained at substantially a predetermined temperature. Therefore, the photosensitive material can be dried at a desired temperature and in an optimal state.

When the photosensitive material is dried in an optimal state, the temperature of the drying air is a factor, but also, it is necessary for the temperature of the rollers and the like within the drying chamber to be an optimal temperature. If the drying air is controlled so that the temperature of the rollers and the like within the drying chamber is maintained at a predetermined temperature, the drying conditions of the photosensitive material can be controlled accurately.

Further, another aspect of the present invention includes heating means for supplying heated drying air to an interior of a drying chamber, and for heating and drying a photosensitive material for which processing by processing solutions has been completed; an exhaust grill through which exhaust air, which is discharged from a vicinity of a conveying path of the photosensitive material to an exterior of the drying chamber, passes; temperature detecting means, disposed in a state in which the temperature detecting means is shielded from the drying air by the exhaust grill, for detecting a temperature of the exhaust grill heated by the exhaust air; and temperature control means for controlling the heating means in accordance with the temperature detected by the temperature detecting means.

In the photosensitive material drying device of the this aspect of the present invention, a temperature detecting means is provided at the exhaust grill through which exhaust air discharged from the interior of the drying chamber passes. Because the temperature detecting means is attached so as to be shielded from the exhaust air by the exhaust grill, the temperature detecting means can accurately detect the temperature of the exhaust grill without being effected by the flow of the exhaust air. The temperature of parts within the drying chamber, such as the rollers, can therefore be set to optimize the drying state.

If temperature control of the drying air is effected based on this temperature, an optimal drying state within the drying chamber can be maintained.

As a result, during start-up of operation of the drying device, if the device is started up while the temperature of the exhaust grill is being detected by the temperature detecting means, there is no need to provide a margin of time for the start-up time. Therefore, the start-up operation can be carried out efficiently in a short period of time. Further, when the photosensitive material is subject to drying processing, a temperature which is substantially the same as the temperature of the rollers or the like within the drying chamber which effects the drying conditions of the photosensitive material, or a correlated temperature can be detected by the temperature detecting means. Therefore, the drying air and members such as the rollers can be controlled to temperatures at which processing of the photosensitive material can be carried out in an optimal state. In addition, temperature control is quite easy.

As described above, in accordance with the temperature control method of a photosensitive material drying device relating to the present invention, the temperature of members within the drying chamber, such as rollers, which the photosensitive material contacts can be easily known without providing a sensor which directly contacts driving parts, such as rollers, within the drying chamber. Therefore, the temperature within the drying chamber can be easily and accurately controlled, and the photosensitive material can be finished in an optimal drying state.

In the photosensitive material drying device relating to the present invention, start-up of operation of the drying device can be effected efficiently and in a short time. Further, an excellent effect can be obtained in that a desired temperature within the drying chamber can be accurately maintained.

DESCRIPTION OF THE PREFERRED EMBODIMENTS

Figure 1:
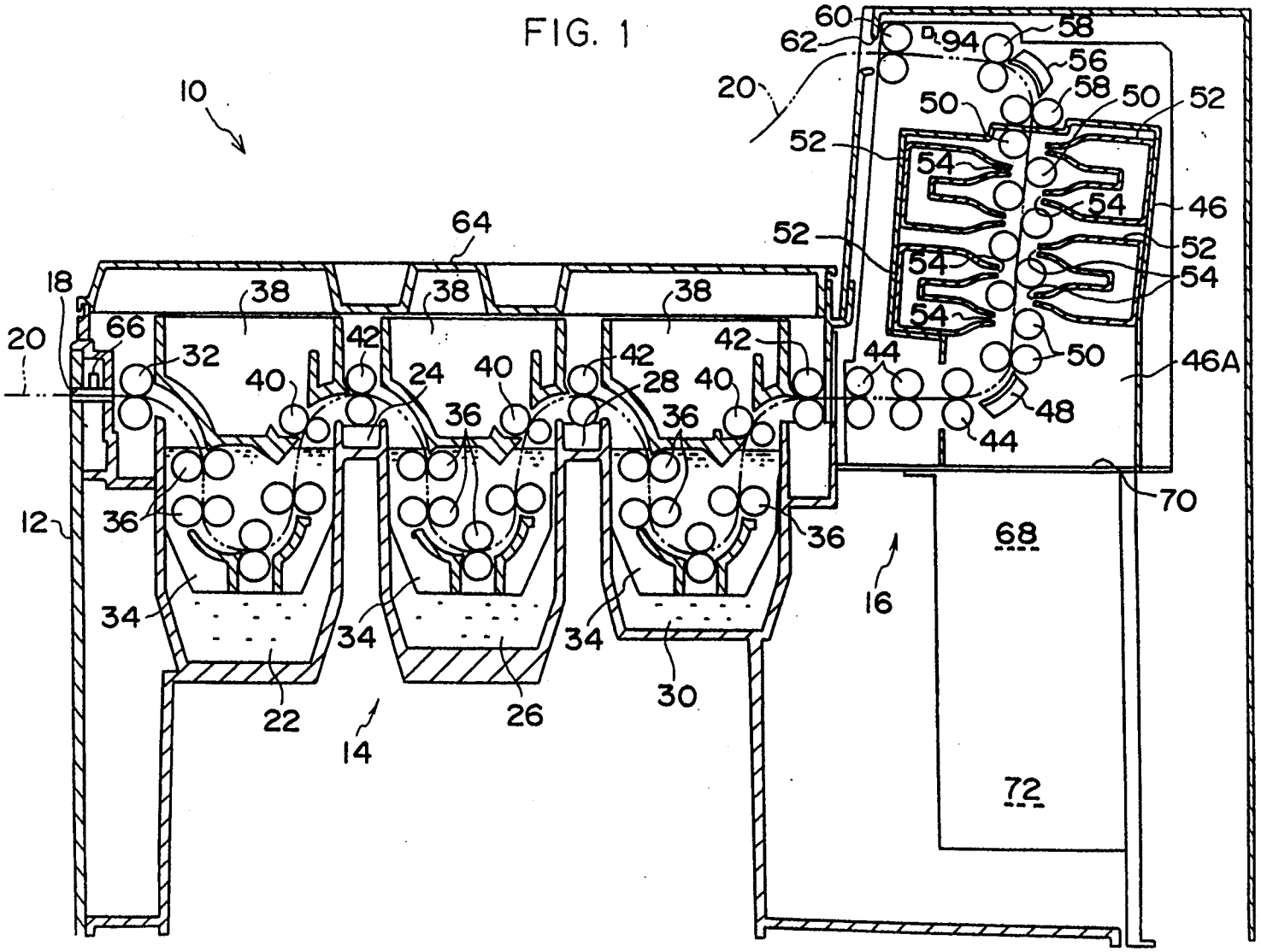
FIG. 1 is a schematic structural view illustrating an automatic developing apparatus applied to the present embodiment.

An automatic developing apparatus 10 applied to the present embodiment is illustrated in FIG. 1. The automatic developing apparatus 10 is provided with a processing solution processing portion 14 within a machine casing 12 and a drying portion 16 to which the present invention is applied. The automatic developing apparatus 10 processes a film 20 which is a photosensitive material. The film 20 on which images are recorded is submerged in developing solution, fixing solution and washing water so as to be subject to developing processing, fixing processing, and washing processing. Thereafter, the film 20 is dried and finished.

The automatic developing apparatus 10 may be used as a unit to process the negative film 20 on which images have been recorded by an image recording device. Alternatively, the automatic developing apparatus 10 may be provided integrally with an image recording device such as a scanner or the like such that after images have been recorded onto the film 20 by the image recording device, the film is subjected in succession to developing, fixing and washing processes, and is thereafter dried and finished.

An insertion opening 18, through which the film 20 is inserted, is provided at the automatic developing apparatus 10 at the upstream side edge portion of the machine casing 12 (the left side surface in FIG. 1). A pair of insertion rollers 32, which are rotated by an unillustrated driving means, is provided inwardly of the insertion opening 18. The film 20 inserted from the insertion opening 18 is guided by the driving force of the pair of insertion rollers 32 to the processing solution processing portion 14 disposed inside the automatic developing apparatus 10. An insertion sensor 66 which detects the inserted film 20 is disposed inwardly of the insertion opening 18. Due to the film sensor 66, the length of the film 20, whether the film 20 is being processed, and tile like can be determined.

A plurality of processing tanks are provided in the processing solution processing portion 14. From the upstream side (the left side in FIG. 1), the processing tanks are a developing tank 22, a rinsing tank 24, a fixing tank 26, a rinsing tank 28, and a washing tank 30. Developing solution, fixing solution and washing water are respectively stored in the developing tank 22, the fixing tank 26 and the washing tank 50 (hereinafter referred to generically as "processing tanks"). Washing water (e.g., water or acetic acid aqueous solution) in the rinsing tank 24 and washing water (e.g., water) in the rinsing tank 28 are supplied from respective storage tanks through conduits due to the driving of pumps. Excess washing water overflows from the rinsing tanks 24, 28 into unillustrated overflow tanks. When water is used as the washing water, the storage tanks may be omitted, and a conduit may be provided which supplies water directly from the tap to the rinsing tanks 24, 28 via a solenoid valve or the like so that tap water is supplied to the rinsing tanks 24, 28 as washing water.

A rack 34 is provided in each of the processing tanks 22, 26, 30. In each rack 34, a plurality of pairs of rollers 36 is provided such that a conveying path is formed in which the film 20 is sandwiched between the pairs of rollers 36 and is guided and conveyed within each processing tank in a substantially U-shape. The film 20 is submerged in the processing solutions in the respective processing tanks while being conveyed along the conveying paths.

A crossover rack 38 is disposed above each of the processing tanks 22, 26, 30. Pairs of conveying rollers 40, which are positioned at the respective downstream portions of the processing tanks, and pairs of conveying rollers 42, which are located above the rinsing tanks 24, 28 and at the downstream side of the washing tank 30, are disposed at the crossover racks 38. The pairs of conveying rollers 40, 42 sandwich the film 20 so as to convey the film 20 to the adjacent processing tank, and remove processing solution adhering to the film 20. Further, the lower side surfaces of the crossover racks 38 respectively serve as floating lids which cover the liquid surfaces of the processing solutions within the processing tanks 22, 26, 30 and which prevent the developing solution and the fixing solution in particular from contacting the outside air.

Further, an unillustrated heat exchanger is disposed beneath the developing tank 22 and the fixing tank 26. When the developing solution within the developing tank 22 and the fixing solution within the fixing tank 26 are agitated by circulating means, the developing solution and the fixing solution are heated to predetermined temperatures by the heat exchanger provided along the circulating means. As a result, during start-up of the operation of the automatic developing apparatus 10, the developing solution within the developing tank 22 and the fixing solution within the fixing tank 26 are heated to set temperatures at which processing of the film 20 is possible, and are maintained at the set temperatures after start-up of the apparatus.

The drying portion 16 is provided adjacent to the processing solution processing portion 14 at the downstream side (the right side in FIG. 1) thereof. The drying portion 16 is provided adjacent to the downstream side edge portion of the processing solution processing portion 14 and projects upwardly.

In the drying portion 16, moisture adhering to the surfaces of the film 20 is squeezed therefrom as the film 20, which is delivered from the processing solution processing portion 14, is conveyed by a plurality of pairs of squeeze rollers 44. Simultaneously, the film 20 is delivered into a drying chamber 46 which is substantially box-shaped. The drying chamber 46 is provided with a guide 48 and a plurality of conveying rollers 50 which are staggered. The film 20 which is delivered into the drying chamber 46 is guided substantially upwardly by the guide 48, and is conveyed substantially upwardly through the interior of the drying chamber 46 by the plurality of conveying rollers 50.

Further, a plurality of blow pipes 52 is disposed within the drying chamber 46 such that the conveying path of the film 20 is interposed therebetween. Each of the blow pipes 52 is provided with a nozzle 54 which is oriented toward the conveying path of the film 20. The blow pipes 52 are disposed along the transverse direction of the conveying of the film 20, and supply drying air, which is generated and heated by a drying air generating means which will be described later, from one end in the transverse direction of the film 20. Further, the nozzles 54 are open along the transverse direction of the conveying of the film 20. The sectional area of the space of the interior of the blow pipe 52 becomes gradually smaller from the end portion to which the drying air is supplied to the other end. The drying air supplied to the blow pipe 52 is thereby blown uniformly along the transverse direction of the film 20 from the nozzle 54. The film 20 is heated and dried by the drying air.

A guide 56, pairs of conveying rollers 58, which are provided at both sides of the guide 56, and a pair of discharge rollers 60 are disposed above the drying chamber 46. The film 20 which is discharged from the interior of the drying chamber 46 is guided toward the pair of discharge rollers 60 by the guide 56 while being conveyed by the pairs of conveying rollers 58. Thereafter, the film 20 is delivered out from a discharge opening 62 in a substantially horizontal state by the pair of discharge rollers 60.

A tray 64, in which the film 20 delivered out from the discharge opening 62 is placed, is formed at the upper surface of the machine casing 12 above the processing solution processing portion 14. The films 20 which have been subject to developing, fixing, washing and drying processing in the automatic developing apparatus 10 are stacked in order on the tray 64. Further, a discharge sensor 94 is provided in a vicinity of the inner side of the discharge opening 62. The discharge sensor 94 detects the trailing end of the film 20 which passes through and is discharged from the discharge opening 62.

With reference to FIGS. 1 through 5, description will be given of a drying air generating portion 68 which generates drying air for drying the film 20 in the drying portion 16.

Figure 2:
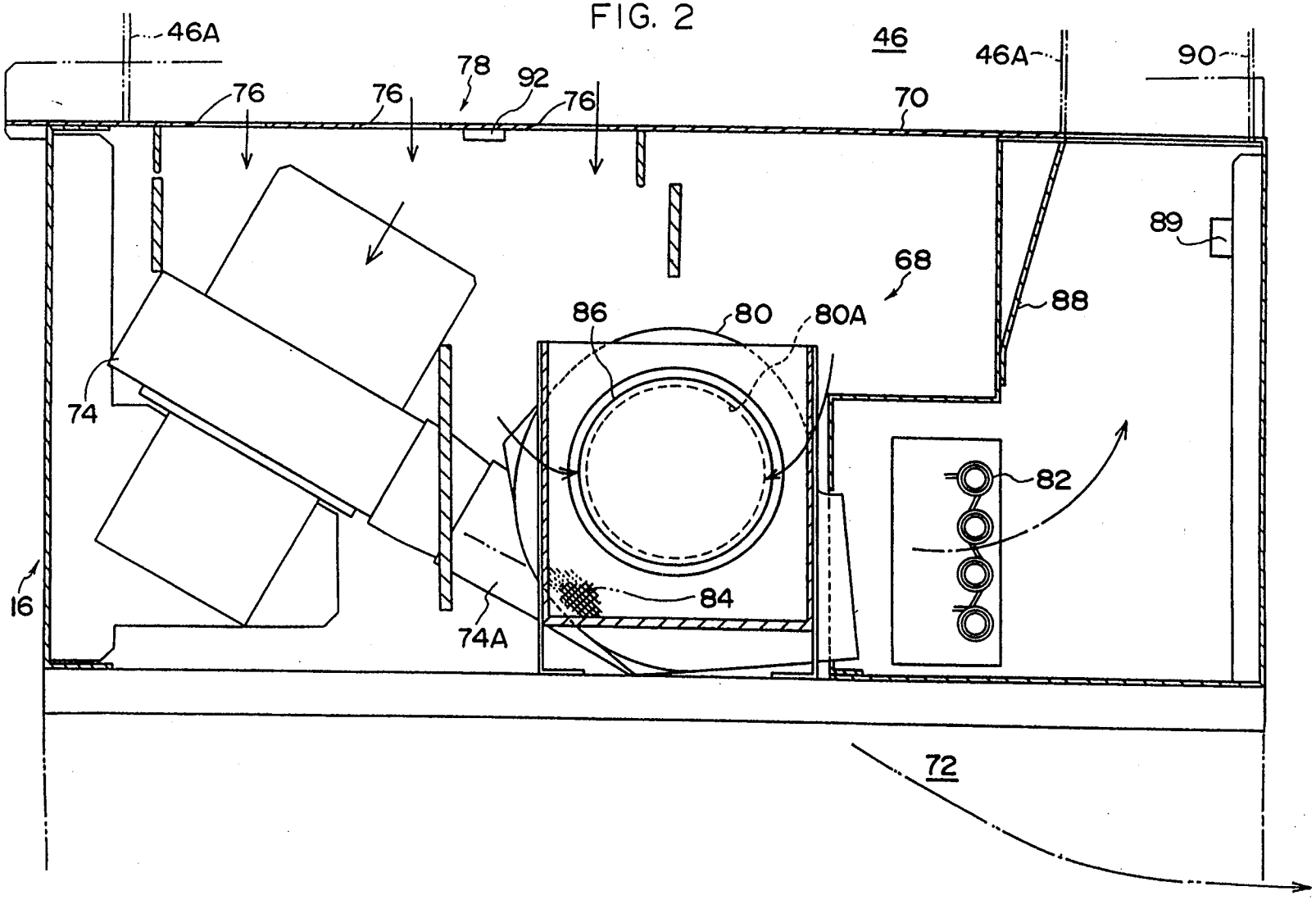
FIG. 2 is a schematic sectional view of a drying air generating portion.
Figure 3:
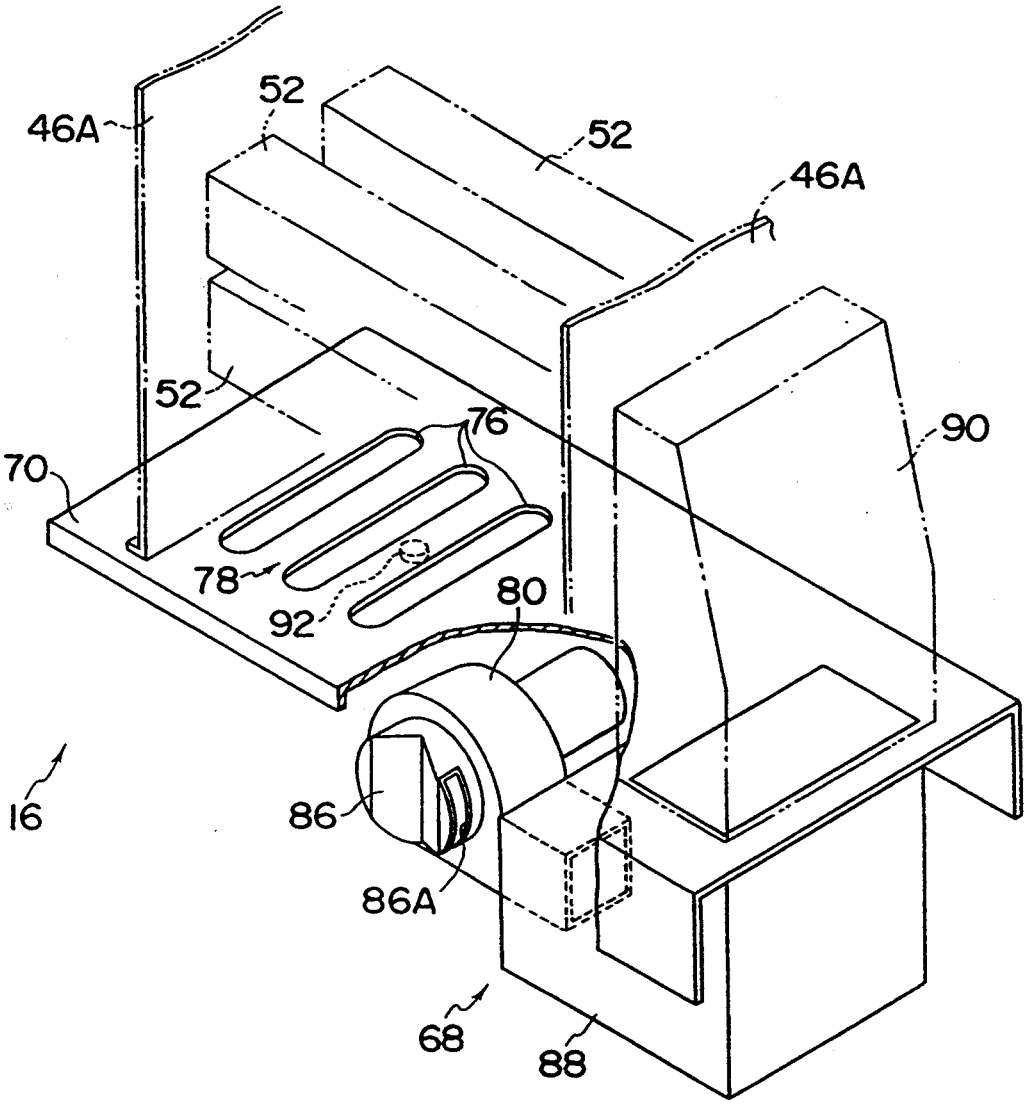
FIG. 3 is a perspective view of main portions of the drying air generating portion.

As illustrated in FIGS. 1 through 3, the drying chamber 46 of the drying portion 16 is disposed on a base 70. A drying air generating portion 68 and a control portion 72 are provided beneath tile base 70. As illustrated in FIGS. 2 and 3, an exhaust fan 74 (shown only in FIG. 2) is provided in the drying air generating portion 68. An exhaust grill 78, in which a plurality of slits 76 is formed, is provided at the base 70. The exhaust grill 78 is formed, for example, of a metal such as stainless steel or the like. When, due to the operation of the exhaust fan 74, air within the drying chamber 46 passes through the exhaust grill 78 and is discharged to the exterior of the apparatus via a duct 74A, the exhaust grill 78 is heated by the air which is being exhausted.

A drying fan 80 and a heater 82, which are adjacent to the exhaust fan 74 and generate drying air, are disposed in the drying air generating portion 68. A centrifugal fan such as a sirocco fan can be used as the drying fan 80, although the drying fan 80 is not limited to such fans. The suction side of the drying fan 80 communicates with a vicinity of the exhaust grill 78, and with the interior of the automatic developing apparatus 10 via a filter 84. Due to the operation of the drying fan 80, a portion of the air which is from the drying chamber 46 and which passes through the exhaust grill 78 is sucked while mixing with air from the exterior of the apparatus which enters from the filter 84 from gaps of the automatic developing apparatus 10.

Figure 4:
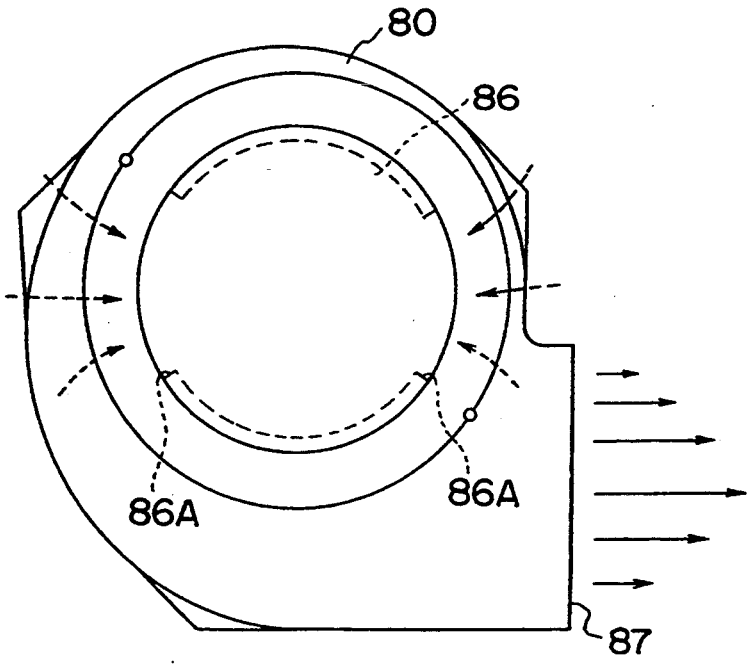
FIG. 4 is a plan view illustrating main portions of a drying fan and an intake grill.

As illustrated in FIG. 4, a suction cover 86 is provided at a suction opening 80A of the drying fan 80. The suction cover 86 is formed as a substantial cylinder in which one of the end surfaces is open. The open end surface is oriented toward the suction opening 80A of the drying fan 80. Further, an opening 86A is formed at a portion of the circumferential surface of the suction cover 86. In a state in which the suction cover 86 is mounted to the drying fan 80, the opening 86A is open in the direction of blowing from the drying fan 80 and in the direction opposite to the direction of blowing. As illustrated in FIG. 4, due to the suction cover 86, the drying fan 80 discharges air at a substantially central portion thereof at a discharge speed which is high compared to the discharge speed at the peripheral portions in a cross-sectional direction of a discharge opening 87. Further, air is discharged from the discharge opening 87 without the entire discharge amount being decreased. Therefore, noise which is caused by friction between the inner walls of the drying fan 80 and the air which is discharged, and by turbulence of the flow of air being discharged which is caused by convex and concave portions of the inner walls of the drying fan 80, and the like can be decreased. At any position of the discharge opening 87, noise can be decreased as compared to a conventional fan at which air is discharged at substantially the same speed.

As illustrated in FIGS. 2 and 3, a chamber 88 is disposed at the blowing direction side of the drying fan 80. The heater 82 and a drying air temperature sensor 89 (shown in FIG. 2) are disposed within the chamber 88. The air delivered into the chamber 88 by the drying fan 80 is heated by the heater 82 so as to generate drying air.

The opening of the chamber 88 at the side opposite the drying fan 80 opposes an opening of a side plate chamber 90 which is provided at a side plate 46A which forms a wall surface of the drying chamber 46. Drying air generated by the drying fan 80 and the heater 82 is supplied to the interior of the side plate chamber 90. Openings of the above-described blow pipes 52 are provided in the side plate chamber 90. Drying air within the side plate chamber 90 is supplied to the interior of the blow pipes 52 from the openings.

A temperature sensor 92 is provided on the base 70 at a lower surface side of the exhaust grill 78. The temperature sensor 92 is disposed between the slits 76 where the flow of air passing through the slits 76 from the drying chamber 46 is obstructed. The temperature sensor 92 can measure the temperature of the exhaust grill 78 heated by the air discharged from the drying chamber 46.

Figure 5:
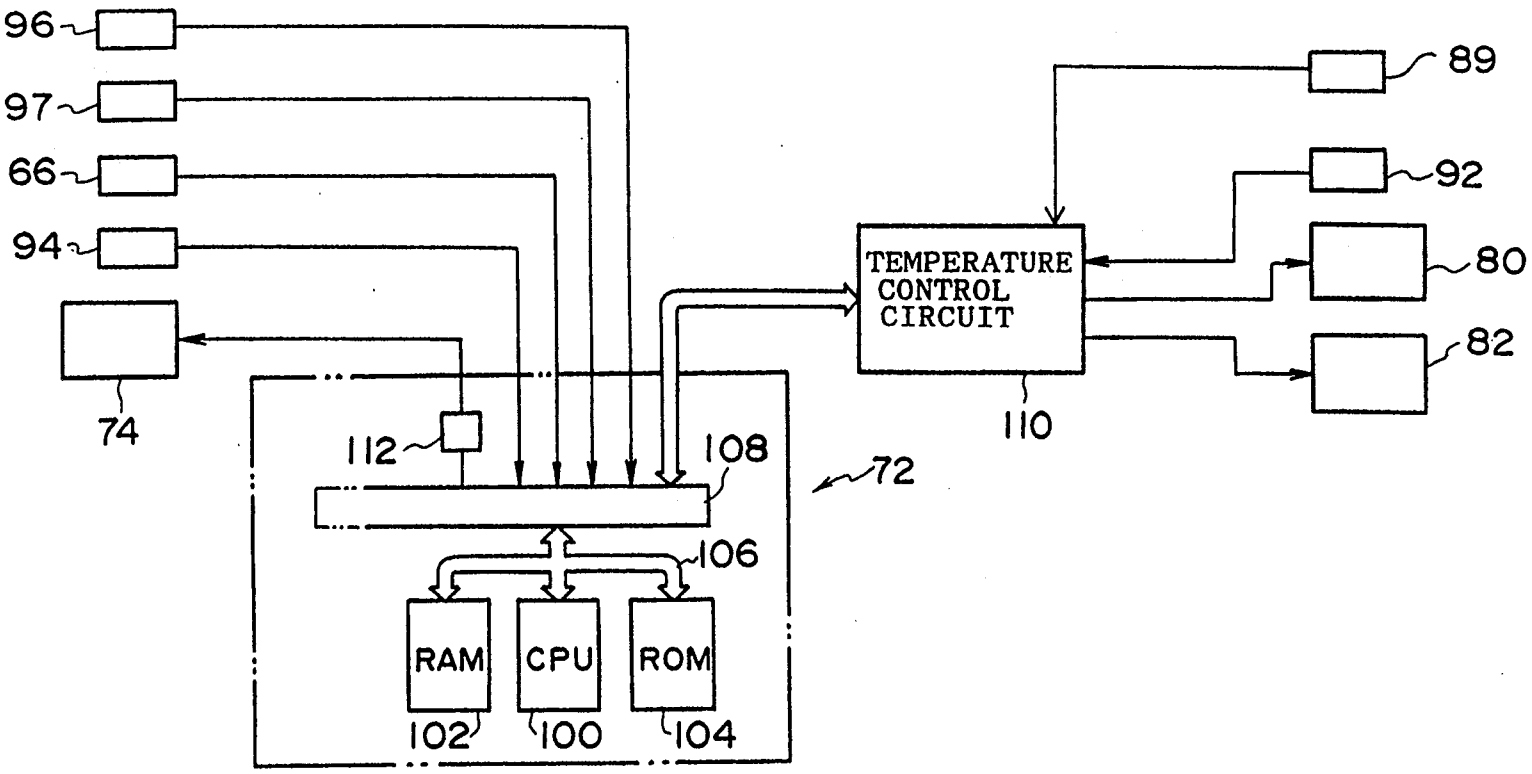
FIG. 5 is a block diagram of main portions of a control portion.

The control portion 72 is disposed beneath the drying air generating portion 68 which is formed by the chamber 88 and the drying fan 80. As illustrated in FIG. 5, the control portion 72 includes a microcomputer in which a CPU 100, a RAM 102, a ROM 104 and the like are connected by busses 106.

The insertion sensor 66, the discharge sensor 94, an exterior temperature sensor 96 and an exterior humidity sensor 97, which respectively detect the temperature and the humidity of the exterior of the automatic developing apparatus 10, and a drying temperature control circuit 110 are connected to the control portion 72 via an I/O port 108. Further, the exhaust fan 74 is connected to the control portion 72 via a driver 112. The drying fan 80, the heater 82, the drying air temperature sensor 89 and the temperature sensor 92 are connected to the drying temperature control circuit 110. The operation of each device of the drying portion 16 is controlled by the control portion 72.

Control of the drying air of the drying portion 16 is effected in the following manner. The temperature and either the relative humidity or absolute humidity of the exterior at the time of start-up of the automatic developing apparatus 10 are measured. A drying set temperature $T_0$ of a standby time when the film 20 is not subject to drying processing, which is detected by the temperature sensor 92, is set based on these measured values. A drying air set temperature $T_{S0}$ of the standby time is set based on the drying set temperature $T_0$. Based on the drying air set temperature $T_{S0}$ of the standby time, the drying fan 80 and the heater 82 are operated by the drying temperature control circuit 110. Drying air is generated, and the parts within the drying chamber 46 such as the conveying rollers 50 and the like are heated to a predetermined temperature.

The drying set temperature $T_0$ is calculated by $T_0=40.5+0.40H$. H is the absolute humidity [g($H_2O$)/kg(dry air)] which is detected by a temperature/relative humidity meter or by an absolute humidity meter which are provided outside of the apparatus. Constants are determined empirically. The drying air set temperature $T_{S0}$ is determined based on the drying set temperature $T_0$ by advance experimentation. The drying set temperatures $T_0$ and the drying air set temperatures $T_{S0}$ are stored in the ROM 104 of the control portion 72.

Further, in the control portion 72, a drying air temperature $T_S$ at which the film 20 is dried is set in accordance with the processing state of the film 20 and based on the drying set temperature $T_0$. Drying air of the appropriate temperature is supplied while the temperature of the exhaust grill 78, through which air discharged from the drying chamber 46 passes, is monitored by the temperature sensor 92 in accordance with the drying air temperature $T_S$. The drying air temperature $T_S$ is set in the control portion 72 so that drying conditions are obtained which are optimal for the operating environment in which the film 20 is set at the automatic developing apparatus 10.

Next, operation of the present embodiment will be explained.

Figure 9:
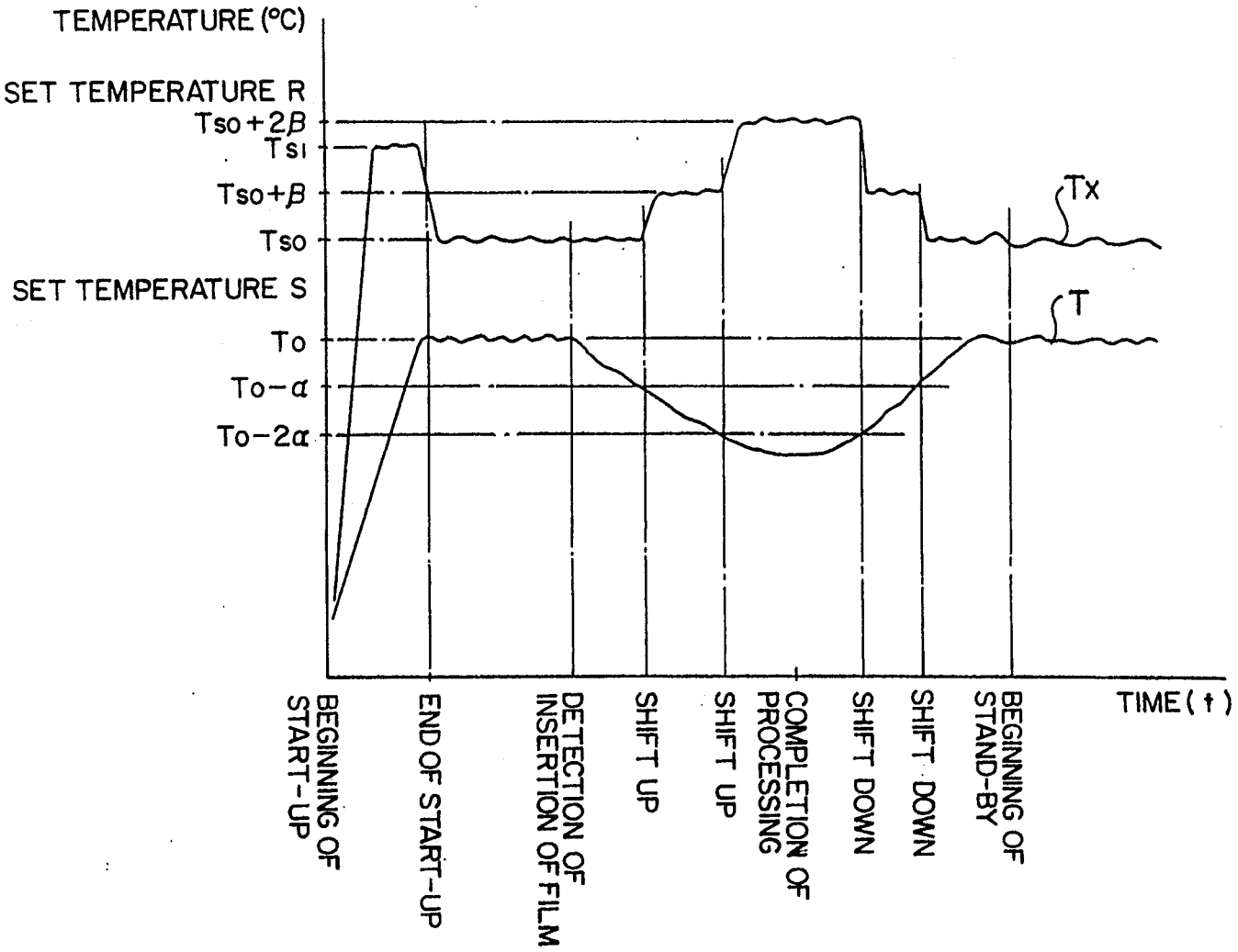
FIG. 9 is a graph illustrating variations in temperature of drying air and an exhaust grill.

When an unillustrated power source of the automatic developing apparatus 10 is turned on, start-up of operation of the apparatus is carried out. During start-up of operation of the apparatus, the developing solution and the fixing solution of the developing tank 22 and the fixing tank 26 of the processing solution processing portion 14 are heated by the unillustrated heat exchanger, and are heated to temperatures for developing processing and fixing processing of the film 20 in an optimal state. As illustrated in FIG. 9, when the power source of the automatic developing apparatus 10 is turned on, in the drying portion 16, the temperature and relative humidity outside the apparatus, i.e., the temperature and relative humidity of the operating environment, are measured by the exterior temperature sensor 96 and the exterior relative humidity sensor 97. The absolute humidity H [g($H_2O$)/kg(dry air)] is determined from the temperature and the relative humidity. The drying set temperature $T_0$ corresponding to the temperature and the relative humidity or the absolute humidity of the operating environment is determined by $T_0=40.5+0.40H$. Instead of the exterior temperature sensor 96 and the exterior relative humidity sensor 97, an absolute humidity sensor may be provided so that the absolute humidity H may be detected directly.

The drying air set temperature $T_{S0}$ of the standby time is set based on the drying set temperature $T_0$. Start-up of operation of the drying portion 16 is effected at the temperature control circuit 110 based on the drying set temperature $T_0$ and the drying air set temperature $T_{S0}$. At the time of start-up, a start-up drying air temperature $T_{S1}$ is set based on the drying set temperature $T_0$.

Figure 6:
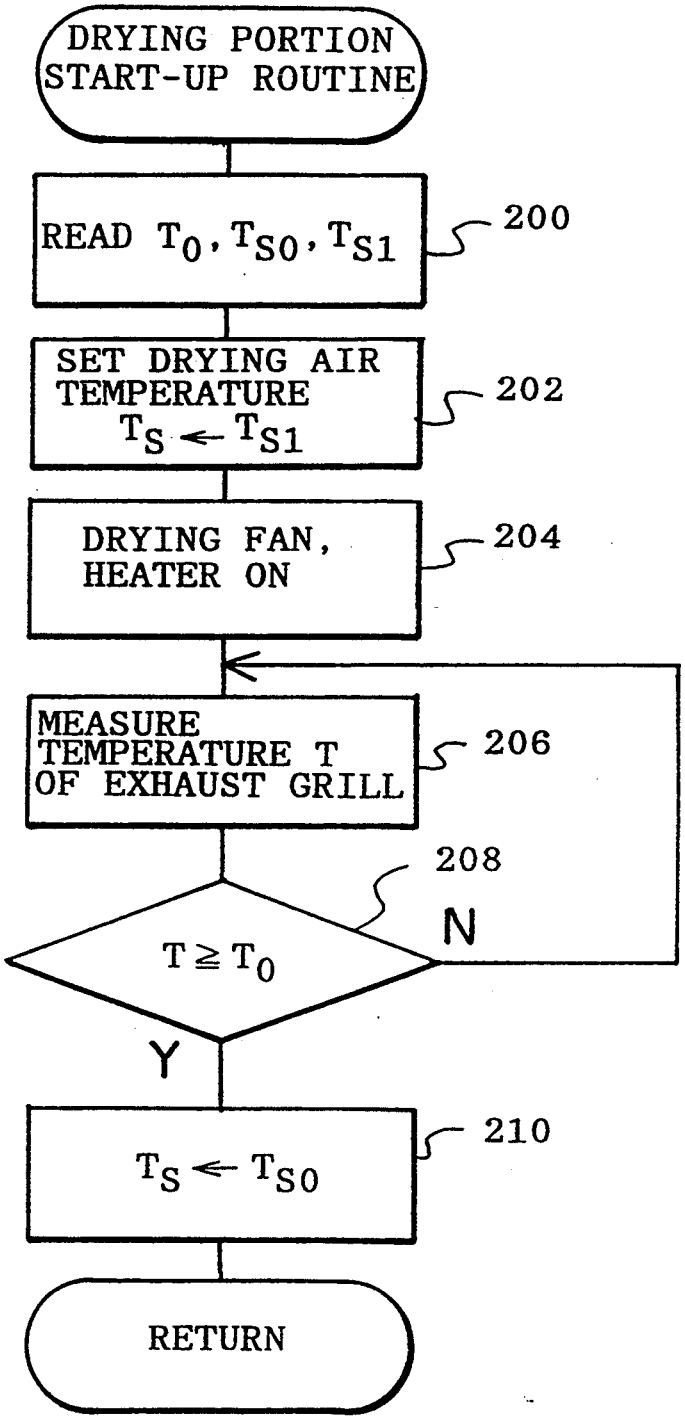
FIG. 6 is a flowchart illustrating start-up of a temperature control circuit.

The flowchart in FIG. 6 illustrates an example of start-up of operation of the temperature control circuit 110.

First, in step 200, the drying set temperature $T_0$, the drying air set temperature $T_{S0}$, and the start-up drying temperature $T_{S1}$ are read. In subsequent step 202, the drying air temperature $T_S$ is set to the start-up drying air temperature $T_{S1}$. In step 204, the drying fan 80 and the heater 82 are operated and drying air is generated. Further, the heater 82 is controlled so as to be turned on and off so that a temperature $T_X$ of the drying air (which is measured by the drying air temperature sensor 89) becomes the start-up drying air temperature $T_{S1}$.

In step 206, a temperature T is measured by the temperature sensor 92. In step 208, it is determined whether the temperature T has reached the drying set temperature $T_0$. If the temperature T measured by the temperature sensor 92 has reached the drying set temperature $T_0$, the drying air temperature $T_S$ is set to the drying air set temperature $T_{S0}$ (step 210), and start-up of the operation of the drying portion 16 is completed.

Accordingly, the temperature of the exhaust grill 78, i.e., the temperature T within the drying chamber 46, is subject to operation start-up processing as illustrated in FIG. 9. At this time, by setting the drying air temperature $T_S$ to the start-up drying air temperature $T_{S1}$, which is a relatively high temperature, start-up of the operation of the drying portion 16 can be effected in a shorter time.

During start-up of the drying portion 16, the temperature $T_X$ of the drying air generated by the drying fan 80 and the heater 82 is measured. If the temperature T of the exhaust grill 78 is made to reach a predetermined temperature by the drying air of temperature $T_X$, start-up of the drying portion 16 can be effected in a short time as compared with conventional methods in which drying air is supplied to the drying portion 16 for a predetermined time during start-up of the drying portion 16. When drying air is supplied to the drying portion 16 for a predetermined time in accordance with conventional methods, start-up of operation is effected by giving a margin of time for the temperature of the members within the drying chamber 46, such as the conveying rollers 50, to become sufficiently high. Therefore, the temperature of the members which reflects the temperature of the conveying rollers 50 and the like in the drying chamber 46 is once raised higher than the drying set temperature $T_0$, and the start-up time of the drying portion 16 is made longer by that much. However, if start-up of the operation of the drying portion 16 is effected such that the temperature T measured by the temperature sensor 92 becomes the drying set temperature $T_0$, start-up can be effected efficiently and in a short period of time.

The temperature T detected by the temperature sensor 92 is the temperature at which the parts within the drying chamber 46 such as the conveying rollers 50 are heated and is the temperature of the exhaust grill 78 heated by the air being discharged from the interior of the drying chamber 46. The temperature T is therefore substantially the same temperature as that of the parts within the drying chamber 46 such as the conveying rollers 50. If the temperature of the exhaust grill 78 is raised to the preset drying set temperature $T_0$, the interior of the drying chamber 46 at that time becomes a temperature at which drying process of the film 20 can be started.

At the automatic developing apparatus 10, for which start-up of operation has been completed, when the film 20 is inserted from the insertion opening 18, the film 20 is conveyed while being submerged successively in the developing tank 22, the fixing tank 26, and the washing tank 30. After developing, fixing, and washing processing have been carried out, the film 20 is delivered into the drying portion 16. In the drying portion 16, the drying air generated by the drying fan 80 and the heater 82 is oriented toward the surfaces of the film 20 being conveyed within the drying chamber 46, is blown out from the nozzles 54 of the blow pipes 52, and heats and dries the film 20.

Further, in the automatic developing apparatus 10, after the film 20 is heated and dried in the drying portion 16, the film 20 is sandwiched and conveyed by the discharge rollers 60 and is delivered out from the discharge opening 62 so as to be discharged to the exterior of the apparatus. In this way, at the automatic developing apparatus 10, the film 20 undergoes drying processing after being subject to developing, fixing, and washing processing.

Temperature control of the drying air which heats and dries the film 20 at the automatic developing apparatus 10, for which start-up of operation has been completed, will now be described in detail with reference to the flowcharts in FIGS. 7A, 7B and 8. The temperature $T_X$ of the drying air controlled by these flowcharts and variations over time of the temperature T of the exhaust grill 78 are illustrated in the graph in FIG. 9.

Figure 7A:
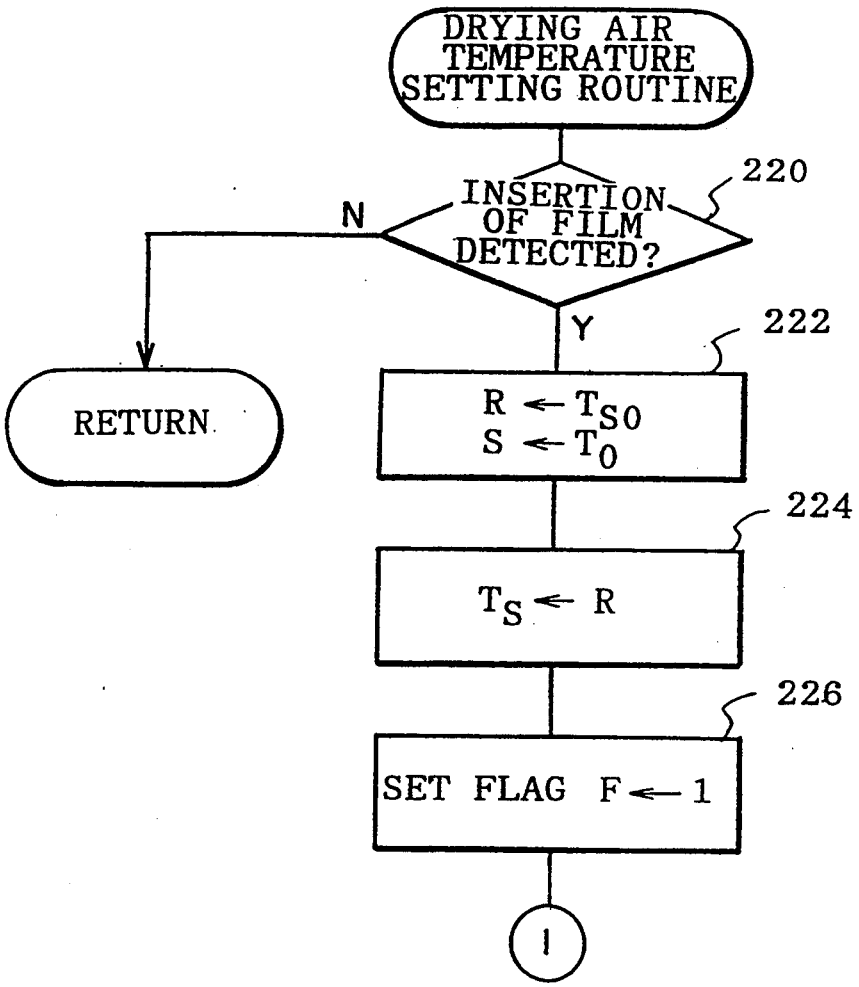
FIGS. 7A and 7B are flowcharts illustrating the setting of a drying air temperature of the control portion related to the present embodiment.
Figure 7B:
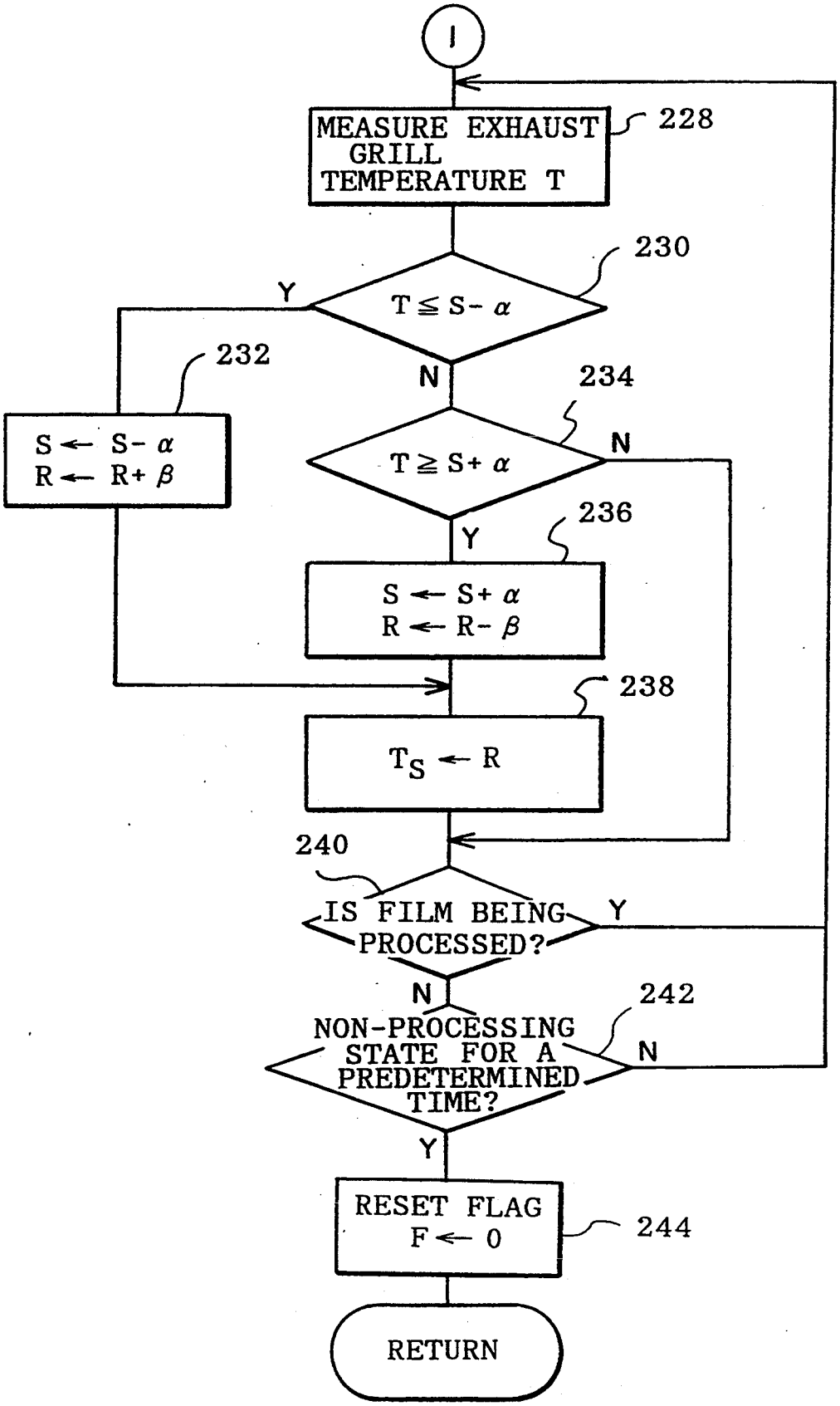
Figure 8:
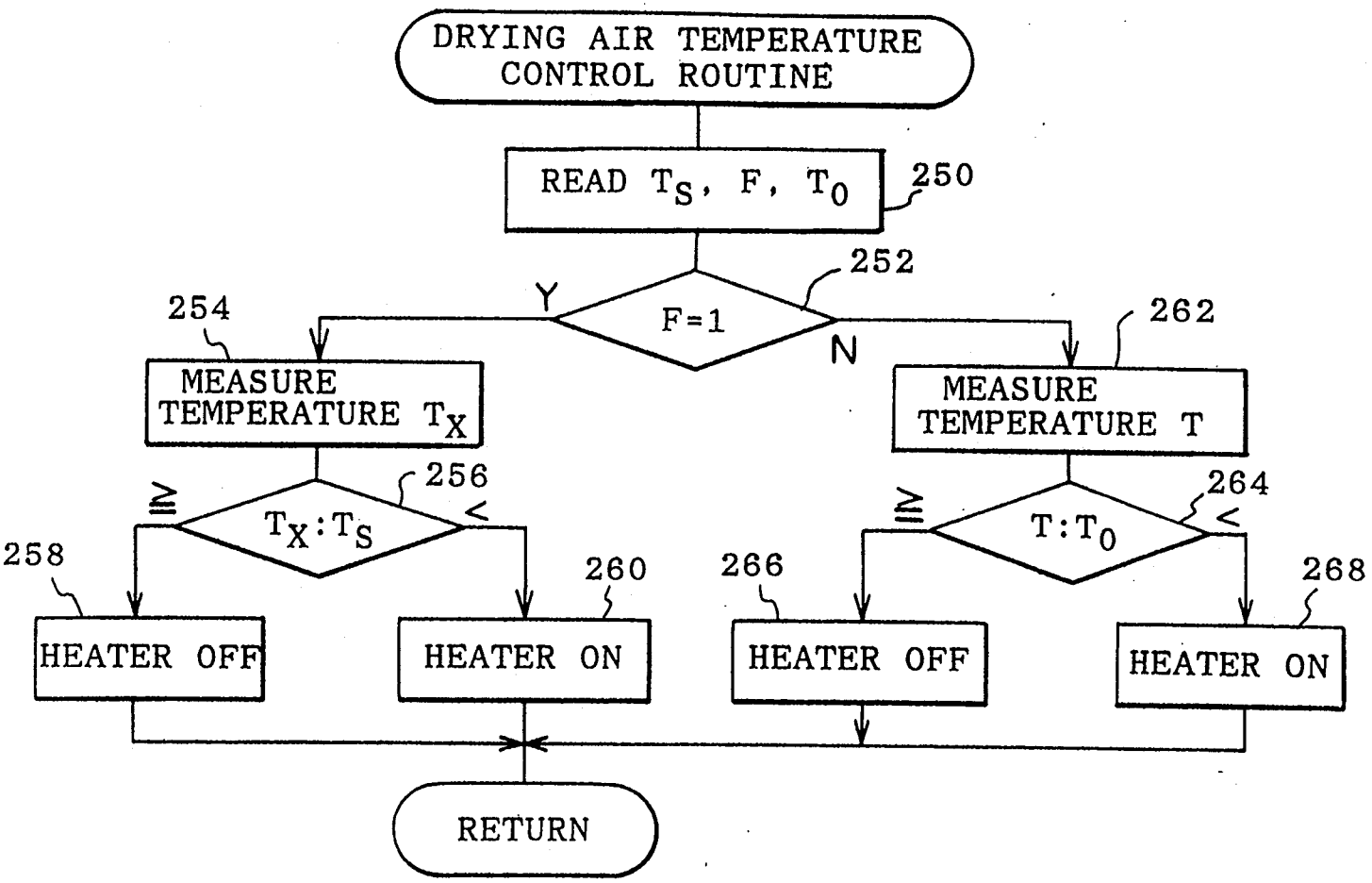
FIG. 8 is a flowchart illustrating operation of the temperature control circuit corresponding to the flowchart in FIG. 7.

FIGS. 7A and 7B illustrate an example of a drying air temperature setting routine at the control portion 72 for setting the drying air temperature $T_S$ within the drying chamber 46. FIG. 8 illustrates an example of a flowchart for control of the drying air by the drying temperature control circuit 110 based on the drying air temperature $T_S$ set by the control portion 72. First, setting of the drying air temperature $T_S$ will be explained in accordance with the flowchart in FIG. 7.

In initial step 220, the insertion sensor- 66 detects whether the film 20 has been inserted into the automatic developing apparatus 10. When the film sensor 66 detects that the film 20 has been inserted from the insertion opening 18 of the automatic developing apparatus 10, a set temperature R is set to the drying air set temperature $T_{S0}$, and a set temperature S is set to the drying set temperature $T_0$ (step 222). In step 224, the drying air temperature $T_S$ is set to the set temperature R. Namely, the drying air temperature $T_S$ is set to the drying air set temperature $T_{S0}$. In subsequent step 226, a flag F is set, and the drying portion 16 is set in a state for processing the film 20. Accordingly, air generated by the drying fan 80 is heated by the heater 82 based on the drying air temperature $T_S$, and is supplied to the interior of the drying chamber 46 as drying air. Heating and drying processing of the film 20 being conveyed within the drying chamber 46 begins.

In step 228 (FIG. 7B), the temperature T of the exhaust grill 78 is measured by the temperature sensor 92. A determination is made as to whether the temperature T is lower than the set temperature S (which becomes the drying set temperature $T_0$) by a predetermined temperature $\alpha$ (e.g., 1° C.) (step 230). If the temperature T is lower than the set temperature S by the predetermined temperature $\alpha$, in step 232, the set temperature S is lowered by the predetermined temperature $\alpha$ so as to be reset, and the set temperature R is raised by a predetermined temperature $\beta$ (e.g., 3° C.). The drying air temperature $T_S$ is set to the set temperature R, and the drying air temperature $T_S$ is shifted up by the predetermined temperature $\beta$ (step 238). Temperatures determined in advance by experimental results can be used for the predetermined temperatures $\alpha$, $\beta$.

Namely, when the temperature $T_X$ of the drying air is fixed and the film 20 is subject to drying processing, the temperature within the drying chamber 46 gradually falls. Accordingly, the temperature T detected by the temperature sensor 92 falls. When the temperature T decreases by the predetermined value $\alpha$, the drying air temperature $T_S$ is shifted up by the predetermined temperature $\beta$ in order to compensate for the drop in temperature. This process is effected each time the processed amount of the film 20 increases and the temperature T detected by the temperature sensor 92 falls by the predetermined temperature $\alpha$.

Further, when the amount of the film 20 which is processed per unit time becomes small and there is time between processing, the temperature of the interior of the drying chamber 46 which had fallen gradually rises. At this time, when it is detected in step 234 that the temperature T has risen above the set temperature S by the predetermined temperature $\alpha$, in step 236, the set temperature S is raised by the predetermined temperature $\alpha$, and the set temperature R is lowered (shifted down) by the predetermined temperature $\beta$. The drying air temperature $T_S$ is set by the lowered set temperature R (step 238). At this time, the temperature control circuit 110, which will be described later, effects control without the temperature T becoming higher than the drying air temperature $T_S$.

In subsequent step 240, a determination is made as to whether the automatic developing apparatus 10 is processing the film 20. In step 242, a determination is made as to whether a predetermined time has elapsed since the trailing end of the film 20 last discharged from the discharge opening 62 of the drying portion 16 was detected by the discharge sensor 94. When a determination is made that the predetermined period of time has elapsed since processing of the film 20 was completed at the automatic developing apparatus 10, the process proceeds to step 244 where the flag F is reset and the drying portion 16 is set in a stand-by state. At this time, the drying air temperature $T_S$ may be returned to the drying air set temperature $T_{S0}$.

Processing of the film 20 at the drying portion 16 is effected on the basis of the drying air temperature $T_S$ set in the manner described above. Processing will be described in accordance with the flowchart illustrated in FIG. 8.

First, in initial step 250, the drying air temperature $T_S$, the drying set temperature $T_0$, and the flag F are read. In step 252, a determination is made from the state of the flag F as to whether the drying portion 16 is to effect processing of the film 20 or whether the drying portion 16 is to be in the stand-by state. When the flag is set such that the film 20 is to be subject to drying processing (F=1), the process proceeds to step 254 where the temperature $T_X$ of the drying air is measured by the drying air temperature sensor 89. When it is determined in step 256 that the temperature $T_X$ is greater than or equal to the drying air temperature $T_S$, the process moves to step 258 where the heater 82 is set in an off state. When it is determined that the temperature $T_X$ is less than the drying air temperature $T_S$, the heater 82 is set in an on state (step 260). Namely, the heater 82 is subject to on/off control so that the temperature $T_X$ becomes the drying air temperature $T_S$.

Further, when the drying portion 16 is in the stand-by state (F=0), the process proceeds to step 262 where the temperature T of the exhaust grill 78 is measured by the temperature sensor 92. When a determination is made in subsequent step 264 that the temperature T is greater than or equal to the drying set temperature $T_0$, the heater 82 is set in an off state (step 266). Further, when a determination is made that the temperature T is less than the drying set temperature $T_0$, the heater 82 is set in an on state (step 268). Namely, in the stand-by state, the temperature T of the exhaust grill 78 heated by the air discharged from the drying chamber 46 is maintained at the drying set temperature $T_0$ so that the drying portion 16 can always process the film 20.

By effecting drying temperature control in the drying portion 16 in this manner, the temperature $T_X$ and the temperature T vary as illustrated in FIG. 9. When the film 20 is being processed in the drying portion 16, the temperature T of the exhaust grill 78, which is heated by air, which is discharged from the drying chamber 46 and which has been used to process the film 20, is measured. When the temperature T falls due to the processing of the film 20, the drying air temperature $T_S$ is raised so that the film 20 is processed by high temperature drying air. Therefore, even if a large amount of the film 20 is processed within a short period of time, the film 20 can always be subject to drying processing under optimal conditions.

Namely, when the film 20 is dried, the temperature of the drying air is controlled based on the temperature T of the exhaust grill 78 in order to control the temperature of the interior of the drying chamber 46 which substantially effects the drying state of the film 10. Accordingly, the drying state of the film 20 can be controlled more precisely, and the film 20 can easily be subject to drying processing in an optimal state.

Further, when the drying portion 16 is in the standby state, the temperature T of the exhaust grill 78 is made to become the drying set temperature $T_0$. Therefore, the interior of the drying chamber 46 can always be maintained in a state in which the film 20 can be processed optimally. At this time, there is no need to operate the heater 82, which generates the drying air, unnecessarily and increase the hunting width of the temperature $T_X$ of the drying air. Therefore, the drying portion 16 can efficiently be maintained in the standby state. When standby control is effected, the heater 82 may be subject to on/off control so that the temperature $T_X$ of the drying air becomes the drying air set temperature $T_{S0}$. Alternatively, the amount of air generated by the drying fan 80 may be controlled while the heater 82 is subject to on/off control so that the temperature $T_X$ of the drying air and the temperature T of the exhaust grill 78 become the drying air set temperature $T_{S0}$ and the drying set temperature $T_0$, respectively.

Figure 10A:
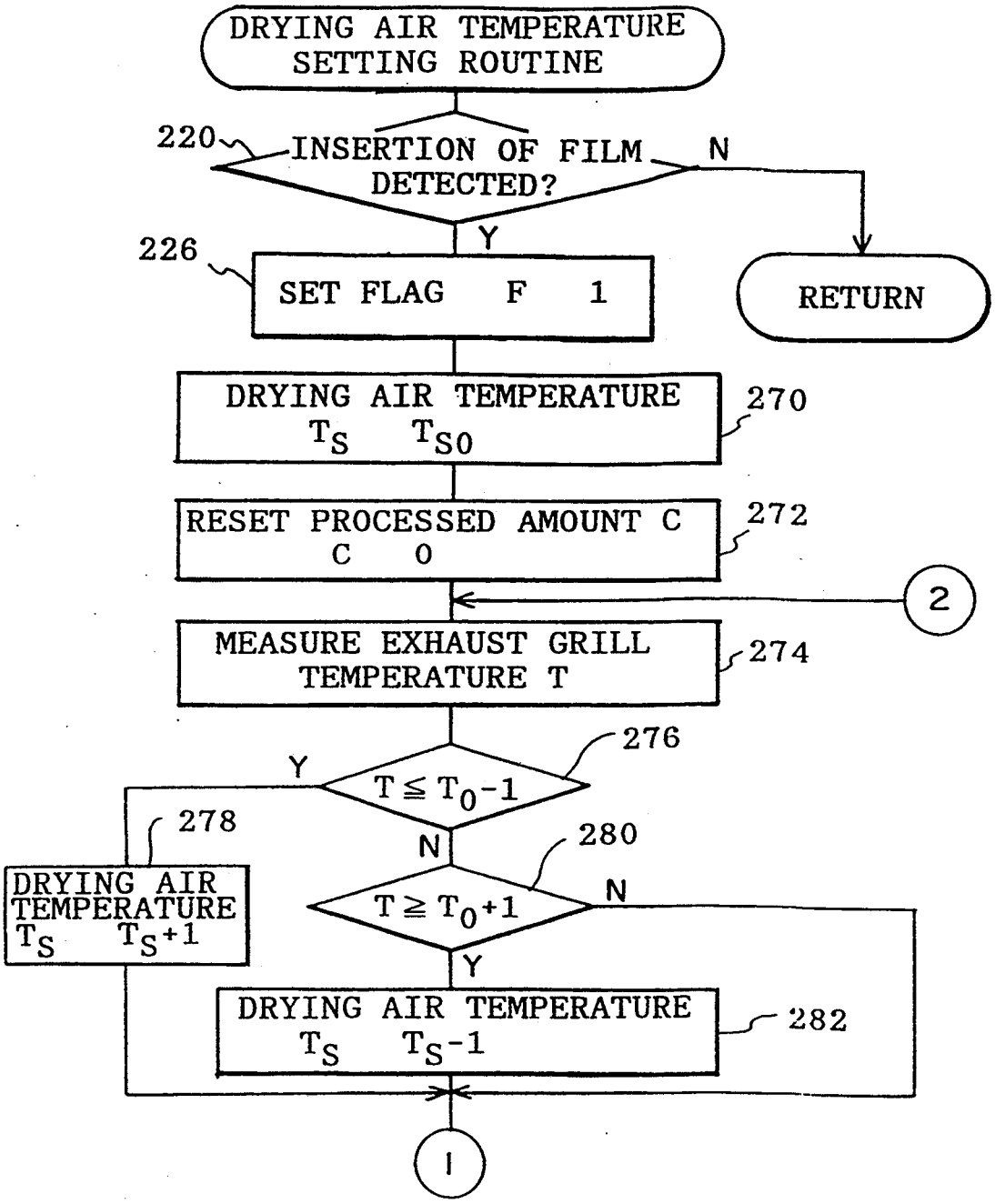
FIGS. 10A and 10B are flowcharts illustrating setting of a drying air temperature of a control portion of a variation of the present embodiment.
Figure 10B:
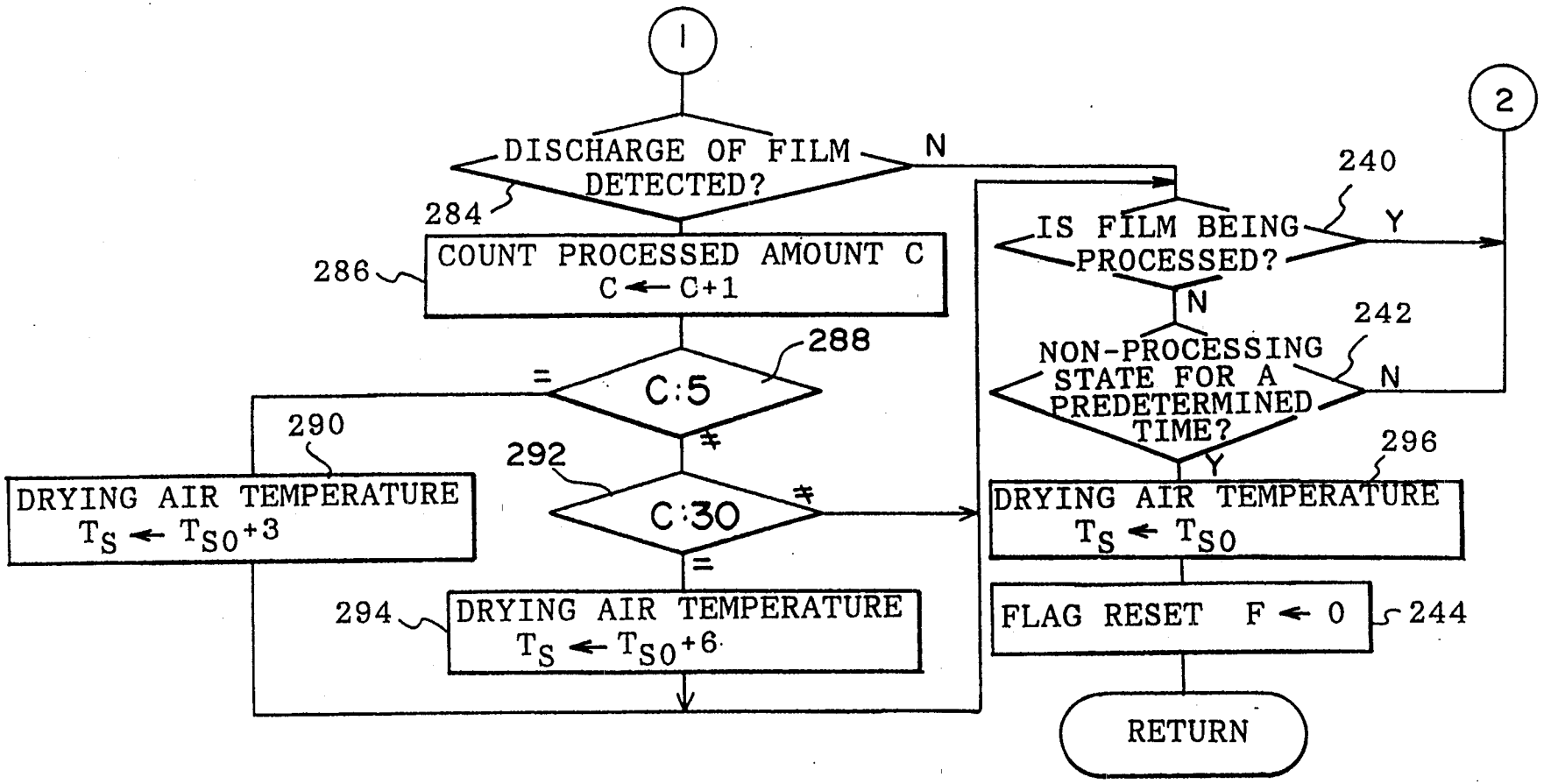

This temperature control of the drying portion 16 illustrates an example of control based on the temperature of a member which is effected by the temperature of the drying air within the drying chamber 46. However, temperature control of the present invention is not limited to the same. For example, as illustrated by the flowchart in FIGS. 10A and 10B, a method may be used in which the temperature T of the exhaust grill 78 is measured by the temperature sensor 92. When the temperature T falls outside of a predetermined temperature range, the temperature of the drying air is adjusted and corrected.

Figure 11:
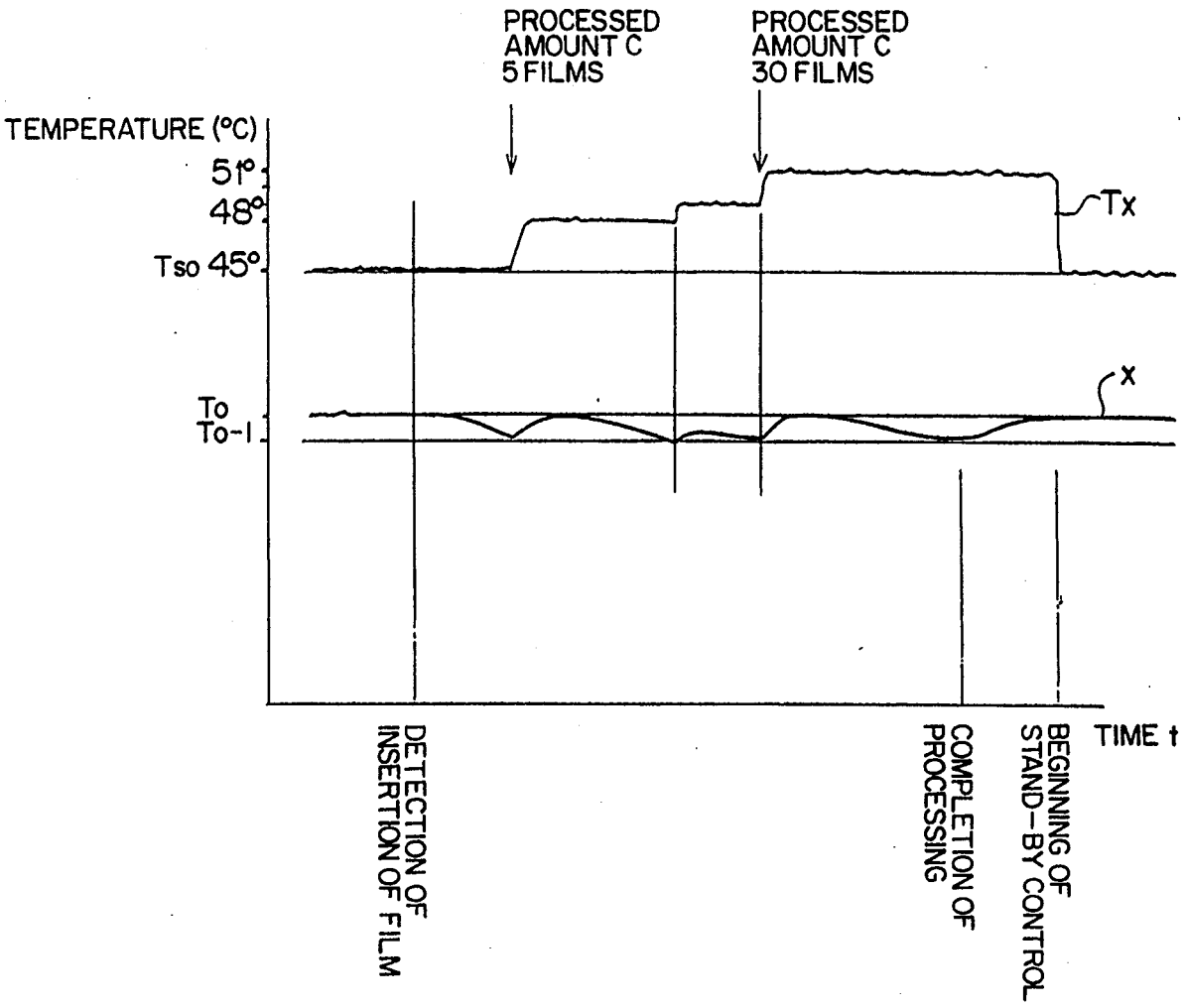
FIG. 11 is a graph illustrating variations in temperature of drying air and the exhaust grill corresponding to FIG. 10.

The flowchart illustrated in FIG. 10 will be described hereinafter. The drying air temperature $T_S$ is determined in advance by experimental results or the like and is stored so that the temperature within the drying chamber 46, i.e., the temperature of the exhaust grill 78, becomes the drying set temperature $T_0$. Further, the drying air temperature $T_S$ is raised in accordance with the processed amount of the film 20 (in the present embodiment, the number of films 20 processed). Here, the drying air set temperature $T_{S0}$ which becomes the drying set temperature $T_0$ is 45° C. The drying air temperature is raised 3° C. each time five films 20 are processed and each time thirty films 20 are processed. The temperature of the interior of the drying chamber 46 is maintained at the drying set temperature $T_0$. Each time the temperature T varies 1° C., the drying air temperature $T_S$ is corrected 1° C. An example of variations of the temperatures $T_X$, T of the drying air and the exhaust grill due to this flowchart is illustrated in the graph of FIG. 11.

In initial step 220, when insertion of the film 20 is detected and the film 20 is inserted and drying processing begins, the flag F is set in step 226. In subsequent step 270, the drying air temperature $T_S$ is set to the drying air set temperature $T_{S0}$ which is determined in advance by experimentation or the like. Accordingly, the temperature T of the exhaust grill 78 is maintained at the drying set temperature $T_0$. In step 272, a processed amount C is reset, and the counting of the processed amount C of the film 20 begins.

In step 274, the temperature T of the exhaust grill 78 is measured by the temperature sensor 92. From the next steps, a determination is made as to whether the temperature T has varied due to the processing of the film 20. In steps 276 and 280, determinations are made as to whether the temperature T has varied from the drying set temperature $T_0$ by at least 1° C. If the temperature T has fallen 1° C. or more, the process proceeds to step 278 where correction is effected such that the drying air temperature $T_S$ is raised 1° C. If the temperature T has risen 1° C. or more, the process proceeds to step 282 where the drying air temperature $T_S$ is lowered 1° C. This correction of the drying air temperature is effected whenever necessary during the processing of the film 20.

In step 284, the trailing end of the film 20 which has been discharged from the drying portion 16 is detected by the discharge sensor 94. In subsequent step 286, the processed amount C is counted. In this way, the processed amount of the film 20 (the number of films 20 processed) since the first film 20 was inserted is counted successively. The drying air temperature $T_S$ is varied based on the processed amount C.

In step 288, a determination is made as to whether the processed amount C has reached five films 20. When the processed amount C is five, the process proceeds to step 290 where the drying air temperature $T_S$ is raised 3° C. with respect to the drying air set temperature $T_{S0}$. Further, when processing of the films 20 continues and the processed amount C reaches thirty films 20 (step 292), the process proceeds to step 294 where the drying air temperature $T_S$ is raised 6° C. with respect to the drying air set temperature $T_{S0}$.

Accordingly, by raising the drying air temperature $T_S$ in accordance with the processed amount C, the temperature T of the exhaust grill 78 can be maintained at about the drying set temperature $T_0$ as illustrated in FIG. 11. Further, even if the drying air temperature $T_S$ varies and the temperature T varies by an amount within a predetermined range or more than the predetermined range (±1° C. with respect to the drying set temperature $T_0$), correction of the drying air temperature $T_S$ is effected in the above-described steps 276 through 282. Therefore, the temperature T of the exhaust grill 78 can be maintained at the drying set temperature $T_0$.

In steps 240 and 242 of the flowchart, when the processing state of the film 20 is checked and a state in which the film 20 is not subject to drying processing has continued for a predetermined time, the process moves to step 296 where the drying air temperature $T_S$ is returned to the drying air set temperature $T_{S0}$. In step 244, the flag F is reset, and the process returns to stand-by control.

Accordingly, not only is the temperature of the drying air raised in accordance with the processed amount C of the film 20, but also, if the drying air temperature $T_S$ is corrected when the temperature T of the exhaust grill 78 is measured and falls outside of a predetermined range (±1° C. in the present embodiment), the temperature at which the film 20 is subject to drying processing can be maintained at the drying set temperature $T_0$, and the film 20 can be processed in an optimal drying state.

The numerical values used in the present embodiment are used as examples to explain the present invention, and it is to be noted that the present invention is not limited to these numerical values. Further, the drying air temperature $T_S$ is raised when the processed amount C of the films 20 reaches five films and reaches thirty films. However, the value of the processed amount C at which the drying air temperature is raised and the amount by which the temperature is raised are not limited to the examples given in the present embodiment. For example, values determined in advance by experimentation with an apparatus to be used may be utilized. These values may be values which should be changed appropriately in accordance with the structure of the drying portion 16 and the material of the photosensitive material to be processed.

Further, the drying portion 16 is changed from the state of processing the film 20 to stand-by control after a predetermined time has elapsed. However, the present invention is not limited to the same. For example, the drying portion 16 may be changed over to the stand-by state when the temperature T of the exhaust grill 78 becomes equivalent to the drying set temperature $T_0$ after the final film 20 is discharged. In the standby control state of the drying portion 16, the temperature T of the exhaust grill 78 is maintained at the drying set temperature $T_0$. Therefore, processing of the film 20 can begin immediately from the stand-by state.

The discharge sensor 94 is provided in a vicinity of the discharge opening 62 of the automatic developing apparatus 10. However, it suffices to not provide the discharge sensor 94. The processing time of the film 20 in the automatic developing apparatus 10 can be determined from the conveying speed and the length of the path (the length of the conveying path of the film 20 from the insertion opening 18 to the discharge opening 62). It may be determined whether the film 20 has been discharged after a fixed time (e.g., the processing time) has passed from the time the leading end of the film 20 is detected by the insertion sensor 66.

Figure 12:
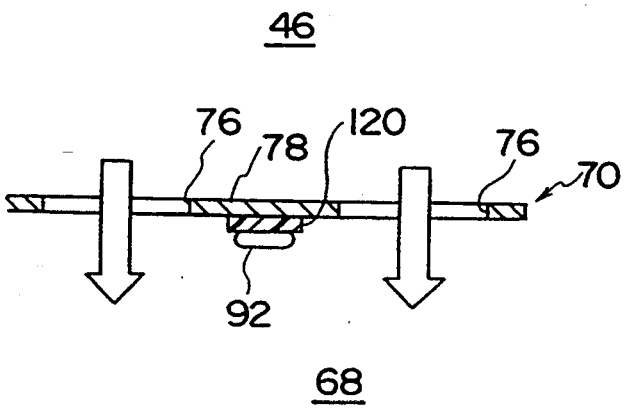
FIG. 12 is a sectional view of main portions illustrating a variation of mounting of a temperature sensor.

In the present embodiment, the temperature of the exhaust grill 78, which is made of a metal such as stainless steel or the like, is measured by the temperature sensor 92. However, the present invention is not limited to the same. For example, as illustrated in FIG. 12, a resin member 120 made of the same material as the conveying rollers 50 may be adhered to the exhaust grill 78, and the temperature of the resin member 120 may be measured. In this way, a temperature which is closer to the temperature of the conveying rollers 50 within the drying chamber 46 can be detected. Further, the resin member 120 may be heated directly by the exhaust air, In this ease, the size of the resin member 120 is set so that the resin member 120 is heated by relatively the same amount of drying air as the conveying rollers 50. Accordingly, the temperature of the conveying rollers 50 and the like within the drying chamber 46 can be detected even more accurately.

The present embodiment does not restrict the structure of the photosensitive material drying device to which the present invention is applied. For example, it suffices that the photosensitive material drying apparatus to which the present invention is applied is not provided integrally with the automatic developing apparatus 10 in which the film 20 is heated and dried in the drying portion 16 after undergoing developing, fixing and washing processing in the processing solution processing portion 14; the photosensitive material drying device may be provided as a separate unit. The photosensitive material drying device is applicable even if another photosensitive material, such as photographic printing paper or the like, is processed in the automatic developing apparatus 10.

What is claimed is:

1. A temperature control method of a photosensitive material drying device comprising the steps of:

directing a flow of drying air heated by a heating element around a photosensitive material to be dried;

detecting a temperature of a component of the drying device that is heated by the drying air; and controlling the heating element so that the temperature of the component is maintained within a predetermined range.

2. A temperature control method of a photosensitive material drying device according to claim 1, wherein the component is separate from other components of the drying device that are used to convey the photosensitive material.

3. A temperature control method of a photosensitive material drying device according to claim 1, wherein the component is disposed out of the flow of drying air in the drying device.

4. A temperature control method of a photosensitive material drying device according to claim 1, the method further comprising the steps of:

detecting a temperature of an operating environment and controlling said heating means in accordance with the detected temperature.

5. A temperature control method of a photosensitive material drying device according to claim 4, the method further comprising the steps of:

detecting a humidity of an operating environment and controlling said heating means in accordance with the detected humidity.

6. A temperature control method of a photosensitive material drying device according to claim 4, the method further comprising the step of:

determining an amount of the photosensitive material to be dried and controlling said heating means according to the determined amount of the photosensitive material.

7. A temperature control method of a photosensitive material drying device according to claim 1, wherein the component is an exhaust grill of a drying chamber through which the photosensitive material is conveyed, and said exhaust grill is used for exhausting the flow of drying air in said drying chamber.

8. A photosensitive material drying device comprising:

a drying chamber through which a photosensitive material to be dried is conveyed;

means for directing a flow of drying air around the photosensitive material in said drying chamber;

heating means for heating the drying air;

temperature detecting means for detecting the temperature of a component of the drying chamber; and control means for controlling said heating means according to the temperature detected by said temperature detecting means.

9. A photosensitive material drying device according to claim 8, wherein the component is separate from other drying chamber components that are used to convey the photosensitive material within the drying chamber.

10. A photosensitive material drying device according to claim 9, wherein the component comprises an exhaust grill through which the drying air in said drying chamber is discharged, and wherein said temperature detecting means comprises a temperature sensor that is at least partially shielded from the drying air and is mounted on said exhaust grill to measure the temperature of said exhaust grill.

11. A photosensitive material drying device according to claim 8, further comprising:

second temperature detecting means for detecting a temperature of an environment; and humidity detecting means for detecting a humidity of the environment, wherein said control means controls said heating means at a time of start-up of operation of said heating means, in accordance with the temperature and the humidity detected by said second temperature detecting means and said humidity detecting means, respectively.

12. A photosensitive material drying device according to claim 8, further comprising:

absolute humidity detecting means for detecting an absolute humidity of an operating environment, wherein said control means controls said heating means, at a time of start-up of operation of said heating means, in accordance with the absolute humidity detected by said absolute humidity detecting means.

13. A photosensitive material drying device according to claim 8, further comprising:

reading means for reading information regarding an amount of said photosensitive material to be dried, wherein said control means controls said heating means on the basis of said information regarding the amount read by said reading means.

14. A photosensitive material drying device according to claim 8, further comprising:

second temperature detecting means for detecting a temperature of an environment;

humidity detecting means for detecting a humidity of the environment; and reading means for reading information regarding an amount of said photosensitive material to be dried by said drying air, wherein said control means controls said heating means, at a time of start-up of operation of said heating means, in accordance with the temperature and the humidity detected by said second temperature detecting means and said humidity detecting means respectively, and said control means controls said heating means, after start-up of operation of said heating means, on the basis of said information regarding the amount such that a temperature of said drying air is raised by a predetermined value when the processed amount is large, and the temperature of said drying air is lowered by a predetermined value when the processed amount is small.

15. A photosensitive material drying device according to claim 8, further comprising:

absolute humidity detecting means for detecting an absolute humidity of an environment; and reading means for reading information regarding an amount of said photosensitive material to be dried by said drying air, wherein said control means controls said heating means, at a time of start-up of said heating means, in accordance with the absolute humidity detected by said absolute humidity detecting means, and said control means controls said heating means, after start-up of said heating means, on the basis of said information regarding the amount such that a temperature of said drying air is raised by a predetermined value when the processed amount is large, and the temperature of said drying air is lowered by a predetermined value when the processed amount is small.

16. A photosensitive material drying device according to claim 10, wherein an exhaust fan is provided in a vicinity of said exhaust grill, and drying air within said drying chamber is exhausted through said exhaust grill and is discharged to an exterior of a main body casing by said exhaust fan.

17. A photosensitive material drying device according to claim 16, wherein a suction side of said blower communicates with a vicinity of said exhaust grill so that air sucked through said exhaust grill from said drying chamber and air sucked from the environment are mixed and supplied into said drying chamber as the drying air.

18. A photosensitive material drying device according to claim 17, further comprising:

a first chamber which is provided at a blowing direction side of said blower and in which said heating means is disposed, wherein the air heated by said heating means is supplied to said drying chamber as the drying air.

19. A photosensitive material drying device according to claim 10, wherein said temperature detecting means is provided at an outside surface of said exhaust grill so as to be shielded from the flow of drying air which passes through from an interior of said drying chamber, said temperature detecting means measuring a temperature of said exhaust grill heated by the drying air exhausted from the interior of said drying chamber.

20. A photosensitive material drying device according to claim 10, wherein said component is made of the same material as rollers disposed within said drying chamber for conveying the photosensitive material.

21. A photosensitive material drying device as recited in claim 8, wherein the component is approximately the same size and the same material as a roller used to convey the photosensitive material in the drying chamber.

22. A photosensitive material drying device as recited in claim 8, wherein the component is disposed in the drying chamber so that the flow of the drying air does not directly impinge on the component.

23. A photosensitive material drying device as recited in claim 8, wherein the component is disposed in the flow of the drying air downstream of the photosensitive material.

24. A temperature control method of a photosensitive material drying device comprising the steps of:

directing drying air heated by a heating element around a photosensitive material to be dried;

detecting a temperature of a member disposed in the drying device and heated by the drying air; and controlling the heating element so that the temperature of the member is maintained within a predetermined range.

25. A photosensitive material drying device comprising:

a drying chamber through which a photosensitive material to be dried is conveyed;

means for directing drying air around the photosensitive material in said drying chamber;

heating means for heating the drying air in said drying chamber;

temperature detecting means for detecting the temperature of a member associated with said drying chamber; and control means for controlling said heating means according to the temperature detected by said temperature detecting means.

26. A temperature control method of a photosensitive material drying device comprising the steps of:

directing drying air heated by a heating element around a photosensitive material to be dried;

detecting the temperature of a member disposed within the drying device; and controlling the heating element so that the temperature of the member is maintained within a predetermined range, wherein the member is disposed out of the flow of drying air in the drying device.

27. A temperature control method of a photosensitive material drying device comprising the steps of:

directing drying air heated by a heating element around a photosensitive material to be dried;

detecting the temperature of a member disposed within the drying device; and controlling the heating element so that the temperature of the member is maintained within a predetermined range, wherein the member comprises an exhaust grill of the drying device.

28. A photosensitive material drying device comprising:

a drying chamber through which a photosensitive material to be dried is conveyed;

means for blowing drying air around the photosensitive material in said drying chamber;

heating means for heating the drying air in said drying chamber;

temperature detecting means for detecting the temperature of a member disposed within said drying chamber;

control means for controlling said heating means according to the temperature detected by said temperature detecting means, wherein the member is separate from components of the drying chamber that are used to convey the photosensitive material, the flow of the drying air does not directly impinge on the member, and said drying chamber comprises an exhaust grill through which the drying air is discharged, said temperature detecting means being shielded from the drying air and mounted on the exhaust grill.

29. A photosensitive material drying device according to claim 28, wherein an exhaust fan is provided in a vicinity of said exhaust grill, and drying air within said drying chamber is exhausted through said exhaust grill and is discharged to an exterior of a main body casing by said exhaust fan.

30. A photosensitive material drying device according to claim 29, wherein a suction side of said blowing means communicates with a vicinity of said exhaust grill so that air sucked through said exhaust grill from said drying chamber and air sucked from the environment are mixed and supplied into said drying chamber as the drying air.

31. A photosensitive material drying device according to claim 30, further comprising:

a first chamber which is provided at a blowing direction side of said blowing means and in which said heating means is disposed, wherein the air heated by said heating means is supplied to said drying chamber as the drying air.

32. A photosensitive material drying device according to claim 28, wherein said temperature detecting means is provided at an outside surface of said exhaust grill so as to be shielded from the flow of drying air which passes through from an interior of said drying chamber, said temperature detecting means measuring a temperature of said exhaust grill heated by the drying air exhausted from the interior of said drying chamber.

33. A photosensitive material drying device according to claim 28, wherein said member is made of the same material as rollers disposed within said drying chamber for conveying the photosensitive material.

34. A photosensitive material drying device comprising:

a drying chamber through which a photosensitive material to be dried is conveyed;

means for blowing drying air around the photosensitive material in said drying chamber;

heating means for heating the drying air;

temperature detecting means for detecting the temperature of a member in the drying chamber; and control means for controlling said heating means according to the temperature detected by said temperature detecting means, said drying device further comprising:

absolute humidity detecting means for detecting an absolute humidity of an environment; and reading means for reading information regarding an amount of said photosensitive material to be dried by said drying air, wherein said control means controls said heating means, at a time of start-up of said heating means, in accordance with the absolute humidity detected by said absolute humidity detecting means, and said control means controls said heating means, after start-up of said heating means, on the basis of said information regarding the amount such that a temperature of said drying air is raised by a predetermined value when the processed amount is large, and the temperature of said drying air is lowered by a predetermined value when the processed amount is small.

* * * * *